United States Patent [19]

Dismukes

[11] Patent Number: 4,523,644

[45] Date of Patent: Jun. 18, 1985

[54] THERMAL OIL RECOVERY METHOD

[76] Inventor: Newton B. Dismukes, 2952 Buttonwood Dr., Carrollton, Tex. 75006

[21] Appl. No.: 546,018

[22] Filed: Oct. 27, 1983

Related U.S. Application Data

[63] Continuation-in-part of Ser. No. 933,272, Aug. 14, 1978, abandoned, which is a continuation-in-part of Ser. No. 829,810, Dec. 23, 1977, abandoned.

[51] Int. Cl.[3] ..... E21B 43/24; E21B 36/00

[52] U.S. Cl. ..... 166/302; 166/57; 166/77

[58] Field of Search ..... 166/250, 173, 77, 302, 166/57; 175/94, 92, 104, 422, 107, 61; 299/34, 13

[56] References Cited

U.S. PATENT DOCUMENTS

| | | | |
|---|---|---|---|
| 2,251,916 | 8/1941 | Cross | 175/107 |
| 2,911,047 | 11/1959 | Henderson | 166/302 |
| 3,373,805 | 3/1968 | Boberg et al. | 166/302 |
| 3,375,885 | 4/1968 | Scott et al. | 175/94 |
| 3,844,362 | 10/1974 | Elbert et al. | 175/422 |
| 3,873,156 | 3/1975 | Jacoby | 175/61 |
| 4,401,159 | 8/1983 | Kofahl | 166/302 |

*Primary Examiner*—Stephen J. Novosad
*Assistant Examiner*—Bruce M. Kisliuk
*Attorney, Agent, or Firm*—Sidney A. Johnson; Drude Faulconer

[57] ABSTRACT

A system for recovery of oil, particularly viscous oil, from subsurface formations penetrated by highly deviated or horizontal bore holes by circulating therethrough a heated fluid. The heated fluid is circulated through a flexible conduit which is pulled into the bore hole by thrust generating means at the forward end thereof. Power to operate the thrust generating means is also conducted through the conduit. Produced oil is returned via the conduit.

29 Claims, 12 Drawing Figures

THERMAL OIL RECOVERY METHOD

RELATED APPLICATIONS

This application is a continuation-in-part of application Ser. No. 933,272, filed Aug. 14, 1978, now abandoned and is directed to the nonelected subject matter disclosed and claimed therein. Application Ser. No. 933,272 in turn was a continuation-in-part of application Ser. No. 829,810, filed Dec. 23, 1977, now abandoned.

BACKGROUND OF THE INVENTION

This invention relates generally to the recovery of viscous petroleum from viscous petroleum containing formations. Major deposits containing such petroleum deposits are located in western Canada, United States and in Venezuela. The depths of such deposits range from surface outcroppings to several thousand feet. This invention is directed to the recovery of petroleum from deposits located where surface mining techniques are impractical, and the injection of steam into the formation via a multiplicity of closely spaced wells is uneconomic or impractical.

To recover petroleum from such deposits proposals have been made to drill bore holes in a generally horizontal direction within the viscous petroleum containing formation. Such horizontal bores may be drilled either by deviating a conventional well bore or by excavating a mined shaft to the desired depth, lowering drilling equipment therein, and drilling the horizontal shafts therefrom. Systems of the latter type are disclosed in U.S. Pat. No. 3,994,340 to Donald J. Anderson et al and in U.S. Pat. No. 4,020,901 to Peter Pisio et al. Such systems are expensive to install especially where the depth of the formation exceeds a few hundred feet. With highly deviated bore holes, and especially where the terminal portion of such bore holes extends for substantial distances in a generally horizontal direction, the problem of introducing equipment for circulating steam and for recovering produced petroleum has not been solved to my knowledge, since the forces of gravity do not provide advancing force in the horizontal bore. Additionally, portions of horizontal well bores often cave in or slough. Therefore, when introducing equipment for heating and producing petroleum therefrom it is very desirable to circulate liquid through such equipment and around the space between the equipment and the bore hole wall to remove any material sloughed off the bore hole walls.

Many systems have been devised for injecting steam directly into the formation via closely spaced wells using either steam drive or the "huff and puff" method. Such steam must be at a pressure higher than reservoir pressure so that it can be injected into the formation. As is well known, the more closely steam approaches the critical condition the less its latent heat. This is the amount of heat required to convert liquid water to vapor and also it is the amount of heat given up when the steam condenses. It is the heat of condensation which provides the principal heat energy serving to raise the temperature of a petroleum reservoir.

For example, steam at 300 pounds per square inch and at a temperature of 417° F. has a latent heat value of 809 BTU per pound. At a pressure of 1500 pounds per square inch and a temperature of 596° F. the latent heat is only 556 BTU per pound.

In order to efficiently and economically heat a reservoir at substantial depth, steam at a pressure well below the reservoir pressure at such depth should be used to effectively heat the petroleum sands. Therefore, for the treatment of such petroleum reservoirs by heating with steam at pressure below reservoir pressures, the steam must be circulated in a closed loop system. The rate of heat flow from a conduit filled with a heatedfluid to a surrounding oil reservoir is controlled by the coefficient of heat transfer from the conduit wall which is measured in BTU per hour per square foot per degree Farenheit temperature difference. A number of factors control an overall coefficient but one which concerns this invention is the kind of insulation surrounding the conduit and its thickness. A conduit surrounded with thick, efficient insulation will transfer heat rather slowly while thin, or no, insulation permits more rapid heat flow. Thus, in a reservoir penetrated by a bore hole containing a steam-filled conduit, a selected portion of the reservoir may be heated preferentially if the conduit in that portion has a high coefficient of heat transfer by comparison with other, more effectively, insulated parts of the conduit. The portion of the conduit extending from the surface to the petroleum containing reservoir should have a low coefficient of heat transfer.

BRIEF DESCRIPTION OF THE INVENTION

The present invention is directed to the provision of a system for recovering viscous petroleum from a formation containing such petroleum via a generally horizontal well bore, such as the terminal portion of a deviated well, by circulating steam therethrough. The invention is especially useful in situations where the petroleum is contained in a reservoir wherein, because of the viscosity of the petroleum under reservoir conditions and in view of the permeability of the reservoir, the reservoir pressure is insufficient to cause the petroleum to flow into a well bore drilled therein at a rate sufficient for economic recovery. By heating the reservoir, the viscosity of the petroleum contained therein will be lowered thus increasing the rate at which the petroleum will drain into or be driven by reservoir pressure into a well bore.

A flexible conduit, capable of conforming to the curvature of the bore hole, carries tubular members providing for closed loop circulation of steam to and return of condensate from the vicinity of the terminal end of the conduit. Means are provided at the terminal end of the conduit for generating forward thrust to render the conduit self-advancing. The conduit conducts the power required to operate the thrust generating means. The conduit also includes a return flow path for produced viscous oil.

Desirably also the conduit provides a path for the introduction of a liquid, such as drilling fluid, for discharge from the terminal end and return circulation around the annulus to remove any sloughed material from the bore hole as the conduit is introduced into the well bore. This circulating liquid under sufficient pressure and volume may provide the necessary power to operate the thrust generating means. Alternatively, the conduit may include or carry conductors for electrical power.

Desirably also the conduit is so constructed that it will be substantially neutrally buoyant in the liquid filling the bore hole so that minimal force will be required for its advance and so that there will be minimal contact between the conduit and the bore hole walls, especially in the non-vertical portions of the well bore.

The term "neutrally buoyant" as used herein means that the conduit when fully immersed in the liquid will weigh not more than 30 percent of its air weight and that a downward force not to exceed 30 percent of its weight in air will completely immerse it.

DETAILED DESCRIPTION OF THE INVENTION

Figures 1, 2, 3:
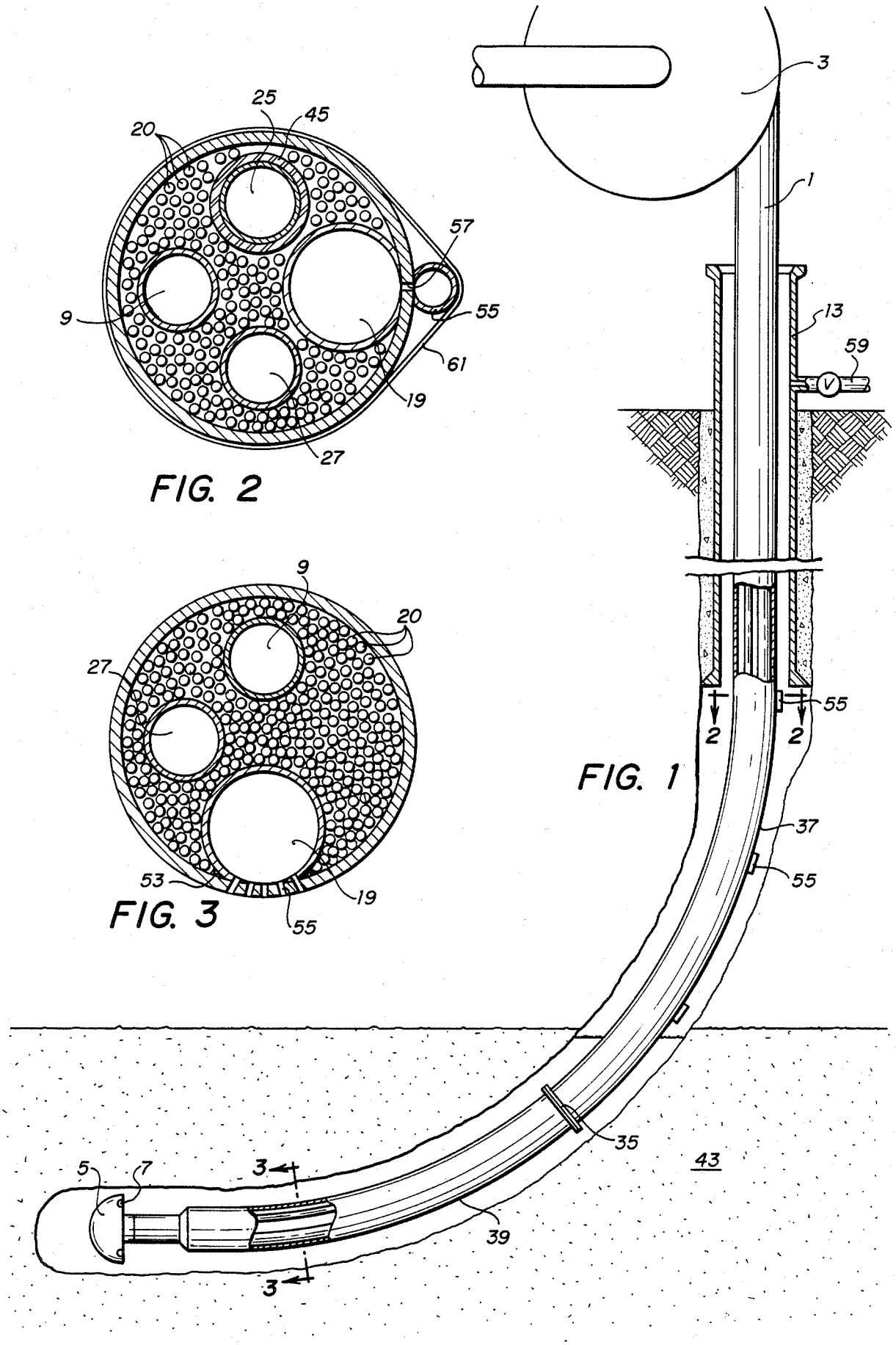
FIG. 1 is a side view, partly in section and partly schematic of a well bore traversing a horizontal petroleum formation with the conduit of the invention in place.
FIG. 2 is a cross-sectional view of the conduit taken on line 2—2 of FIG. 1.
FIG. 3 is a cross-sectional view of the conduit taken on line 3—3 of FIG. 1.

Referring to the drawings, FIG. 1 illustrates the manner in which the flexible conduit is positioned in a bore hole previously drilled in such a manner that its terminal portion penetrates the viscous petroleum containing formation for a substantial distance in a direction generally parallel to the bedding plane of the formation. Since the various earth formations usually are generally horizontal, the terminal portion of the bore hole will also be generally horizontal. A preferred method for drilling a horizontal extension to a bore hole is disclosed in my co-pending application Ser. No. 304,098 filed Sept. 21, 1981.

The flexible conduit 1 is mounted upon a reel 3 and the terminal end carrying the thrust generating means 5 is introduced into the top of the bore hole and the reel unwound to introduce the conduit. In the vertical portion of the well bore, the weight of the conduit is sufficient to cause it to advance as the reel is unwound. The well bore is filled with a drilling fluid to balance the formation pressure and where the conduit is so constructed as to be substantially neutrally buoyant in such a drilling fluid, a weight may be used to enhance the effect of gravity in insuring the descent of the leading end of the conduit as the reel is unwound. For example, a length of steel pipe or a drill collar surrounding the conduit and supported by ears projecting therefrom may provide the necessary mass. When descent of the weight slows, it may be pulled from the well by an attached sand line. As the conduit approaches the more horizontal portions of the well bore, the forces of gravity are no longer effective in insuring the smooth advance of the conduit and the thrust generator takes over as the principal force for advancing the conduit.

As shown in FIG. 1, thrust is generated by the exit of liquid through rearwardly facing jet nozzles 7 in the power head 5 at the terminal end of the conduit. This drilling fluid is introduced under high pressure through the axis of the reel into the other end of the flexible conduit. The drilling fluid passes through an inner conduit 9 (see FIGS. 2 and 4) to the power head from whence it exits through nozzles 7.

After the conduit has been introduced into the well bore to the desired position, the upper end is disconnected from the reel and hung in hanger 11 (see FIG. 5) at the upper end of well casing 13. The reel may then be removed from the vicinity of the well head and suitable connections made for interconnecting the steam generator 15, the condensate return line 29, and the production flow line 51 to the corresponding conduits in the flexible conduit, as shown in FIG. 5.

Figure 5:
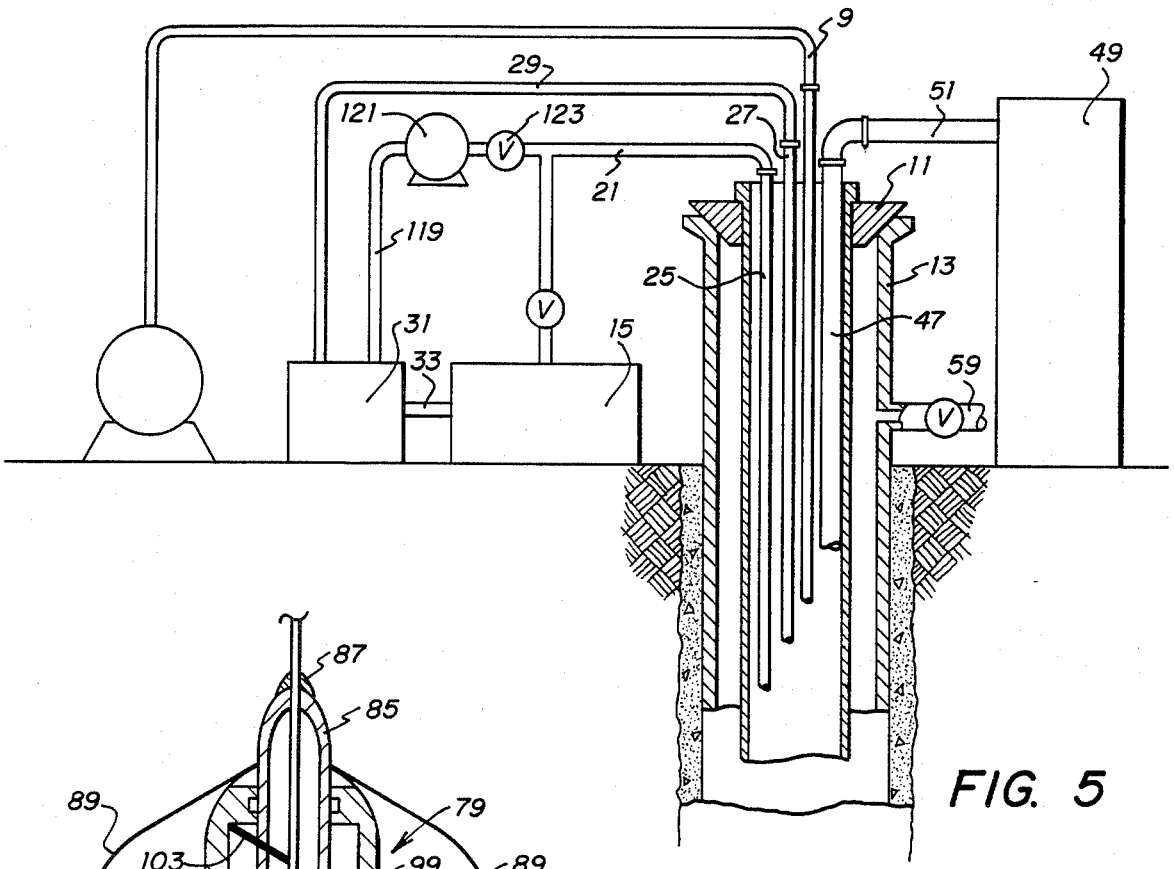
FIG. 5 is a side view, partly in section and partly schematic, of the upper end of the conduit, showing it hung in place on the top of the well casing and connected to the flow lines for the various treating and produced fluids.

As shown in FIG. 5 with the conduit positioned in the well and connected to steam generator 15 by flow line 21, valve 23 may be opened and steam at elevated pressure and temperature will flow from flow line 21 into flow line 25 in conduit 1 to the terminal end of the conduit. During the passage of the steam through the conduit it will give up much of its heat to the formation and the resulting condensate will return to the upper end of the conduit through flow line 27 in the conduit. Desirably, the returning condensate will be returned to the steam generator via flow line 29, treater 31 and line 33 for revaporization.

The conduit is made from low density, flexible materials. The average density of the conduit may be varied and controlled by fillers such as organic or inorganic microballoons 20 to provide low density and resistance to crushing. The outer wall of the conduit may be made from a tough plastic reinforced with woven glass, steel or carbon fibers to give the conduit tensile strength so that it may be pulled into and out from the well bore and so that it will resist crushing. Since it will be exposed to elevated temperatures, the plastic must retain its strength at such temperatures. Suitable plastics for use at temperatures of from 350° F. to as high as 525° F. include Teflon, Nylon-Type 6-12, polyamides and polyimides and various polyesters.

Similar materials may be used to construct the various tubular members for conducting steam, condensate, drilling mud and produced petroleum.

As shown in FIGS. 1–3, the conduit is constructed in two sections joined together, as by end flanges 35. Tubular member 25 for introducing the steam, terminates at the lower end of the upper section 37 of the conduit and the hot steam discharged from member 25 completely fills the hollow portion of the annular space of lower conduit section 39. Desirably the lengths of the two sections are designed so that the junction therebetween is in the vicinity of the point where bore hole 41 enters the petroleum containing formation 43. To minimize the loss of heat during the passage of the hot steam from generator 15 to lower conduit section 39, tubular member 25 desirably is wrapped with insulating material 45, whose thickness may be varied to control heat loss.

Production tubing 19 extends from the vicinity of the terminal end of conduit 1 to the surface where it is connected to product storage tank 49 via flow line 51. In lower conduit section 39 the production tubing is bonded to the lower side of the conduit by a suitable cementing material 53 and the conduit wall and tubing 19 are perforated by holes 56 to allow flow of oil released from the formation by the heat to enter the tubing.

Since this oil is at relatively low pressure, artificial lift means are generally required to raise the oil to the surface. As shown, a series of gas lift valves are provided along the side wall of the upper portion of conduit 37, in communication with conduit 19 via openings 57 in the walls of the conduit and the tubing. Gas under pressure introduced through flow line 59 actuates the gas lift valves and raises the produced oil to the surface. The gas lift valves are fastened to the conduit by metal straps 61 as the conduit is lowered in the well bore. Other artificial lift means may be employed to raise the petroleum produced to the earth's surface.

Figure 4:
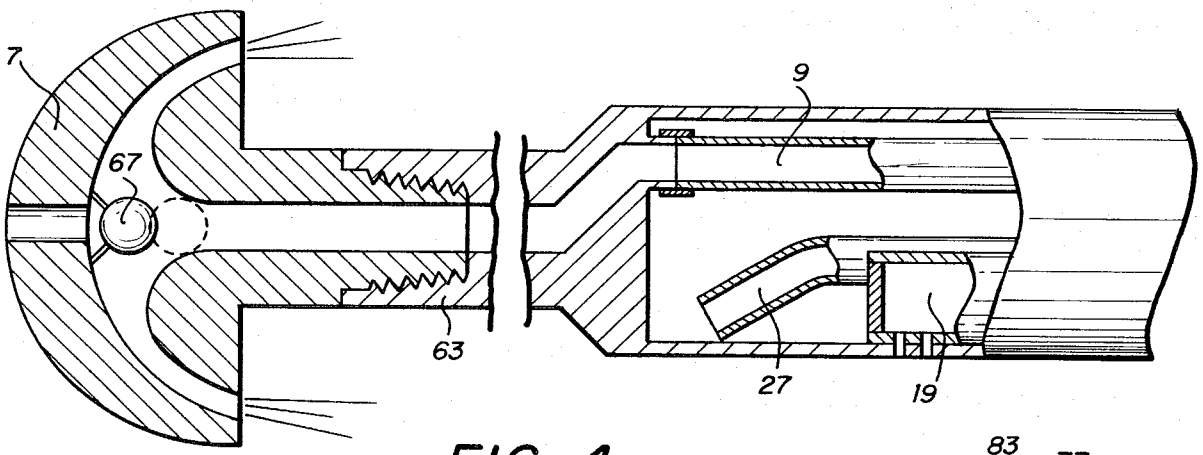
FIG. 4 is a detailed view of the terminal and of the conduit of FIG. 1 and the hydraulic power head form of thrust generator.

The details of the terminal end of the conduit and the hydraulic power head are shown in FIG. 4. Fitting 63 to which the conduit is attached is provided with a passage 65 for the flow of high pressure drilling liquid for discharge from jet nozzles 7 to generate the desired forward thrust. After the conduit has reached the desired position in the well bore, the flow of drilling liquid is terminated. Ball valve 67 prevents the flow of produced oil into line 9.

Figure 6:
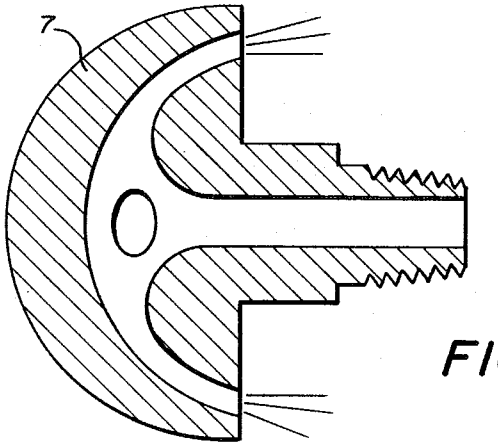
FIG. 6 is a detailed view of an alternate form of the hydraulic power head form of thrust generator for use when the produced petroleum is returned to the surface via the drilling fluid conduit instead of a separate flow line.

In some cases it may be feasible to dispense with production tubing string 19 and produce the liberated petroleum through tubing string 9 after it has served its function as the conduit for drilling liquid to actuate power head 5. In such situations the ball valve to prevent back flow is eliminated as shown in FIG. 6. Operation in this manner is particularly useful where formation solids are not produced.

Figure 9:
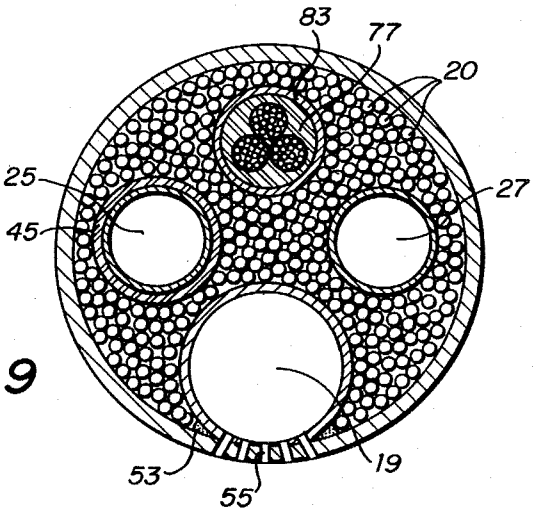
FIG. 9 is a cross-sectional view of an alternate form of conduit for use with an electric powered form of thrust generator.
Figure 7:
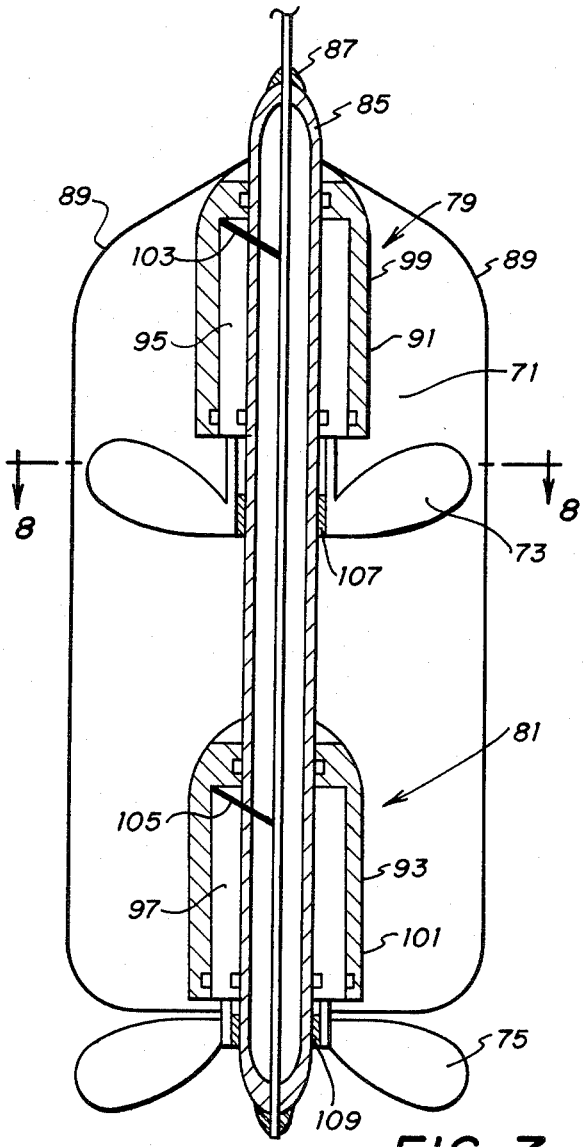
FIG. 7 is a side view, partly in section and partly schematic, of an electrically powered form of thrust generator for a form of conduit of this invention.
Figure 8:
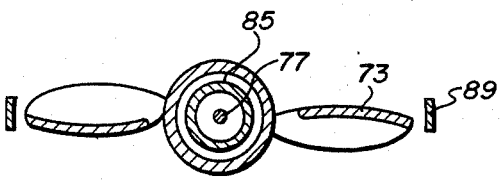
FIG. 8 is a sectional view along the line 8—8 of FIG. 7.

In another embodiment of the present invention shown in FIGS. 7 and 8 an electrical power means, located at the terminal end of the conduit, drives one or more marine screw propellers, 73–75, to advance the apparatus in the bore hole. Electric power from the surface is delivered by conductors 77 (see FIG. 9) in the conduit to the electrically powered thrust generator. Preferably, two electric motors 79–81 turn the two marine screw propellers in opposite directions in the well liquid to tug the conduit forward. Use of counter-rotating propellers eliminates or substantially eliminates torque build up in a highly flexible conduit which could cause kinks and stop the flow of fluids through the tubular members therein. Since there are diameter limitations, the length of the motors may be increased to develop the amount of motor horsepower required to drive the propellers. Use of light weight metals and plastics is maximized in motor manufacture to decrease average motor density. The electric motor may be of the three-phase, squirrel-cage induction type commonly used in driving downhole centrifugal pumps.

Conductor cable 77, which is provided with armor 83 to give adequate tensile strength passes into hollow shaft 85, which may be filled with an insulating low density liquid, through hermetic seal 87. Centralizing means 89 is fixed to the shaft. Also attached to the shaft are electric motors 91 and 93 having rotors 95 and 97 mounted within stators 99 and 101, respectively. Electric power is supplied from cable 77 to the motors by conductors 103 and 105.

Rotation of marine screw propellers 73 and 75 provides forward thrust which is transmitted to shaft 85 by thrust bearings 107 and 109. This thrust in turn is transmitted to cable 77 to tug the conduit forward in the well bore until it reaches the desired position.

Three different motor-conduit combinations may be used with a conductive conduit. In the first a dense motor and instrumentation falls by gravity until the slope of the bore hole becomes too flat for rapid descent whereupon rotation of the propeller continues the downhole progress. A second combination is a neutrally buoyant conduit having descent in the more nearly vertical hole sections speeded by a weight, such as a mass of lead, which rests loosely upon ears on the lower end of the conduit. When descent of the weight slows, it may be pulled from the well and further advance of the conduit effected by propeller rotation. The third combination is completely neutrally buoyant with all descent being caused by propeller rotation.

Figure 10:
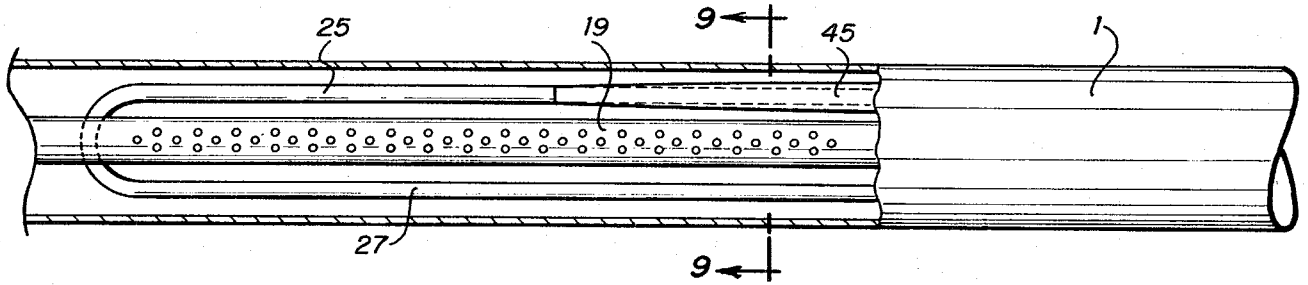
FIG. 10 is a partial bottom view, partly in section and partly schematic, of an alternative form of conduit wherein the steam introduced is circulated through a closed loop of tubing within the conduit.

In FIG. 10, another form of flexible conduit is shown, wherein the steam is circulated to the terminal end of the conduit 1 in a closed loop. In this form, the steam injection tubing extends to the vicinity of the terminal end of conduit 1 where it joins with condensate return conduit 27 as a closed loop. In the lower end 39 of the conduit the tubing 25 is not insulated so that the heat will be more effectively transferred to formation 43.

Alternatively, the amount of insulation around steam line 25 is gradually reduced to zero so that the rate of heat transfer from the condensing steam will be more uniform as indicated in FIG. 10. With this form of conduit the return condensate is lifted back to the surface by the pressure of the incoming steam.

With the form of conduit shown in FIGS. 1 through 4 it may be necessary to provide some form of artificial lift to facilitate the return of aqueous condensate to the surface. This artificial lift may be provided by injecting into the steam entering the upper end of the conduit a small percentage, such as 5% to 15%, by weight of an inert gas, such as nitrogen. This gas will enter the lower end of the condensate return line 27 and aid in lifting the conduit up through the flow line to the surface. As the pressure and temperature of the returning condensate decrease during the flow upward, there may be some flash vaporization of the returning condensate which would also aid in lifting the condensate to the surface. This returned inert gas is separated from the condensate in treater 31 before the condensate is returned to steam generator 15. If desired, the separated inert gas may be recompressed to or slightly above the steam injection pressure and reintroduced via flow line 119, compressor 121 and flow line 123 with the steam into flow line 21. Other artificial lift methods may be employed for aiding the return of the aqueous condensate including the use of gas lift valves in a manner similar to the use of gas lift valves 55 on the produced petroleum return line.

Figure 11:
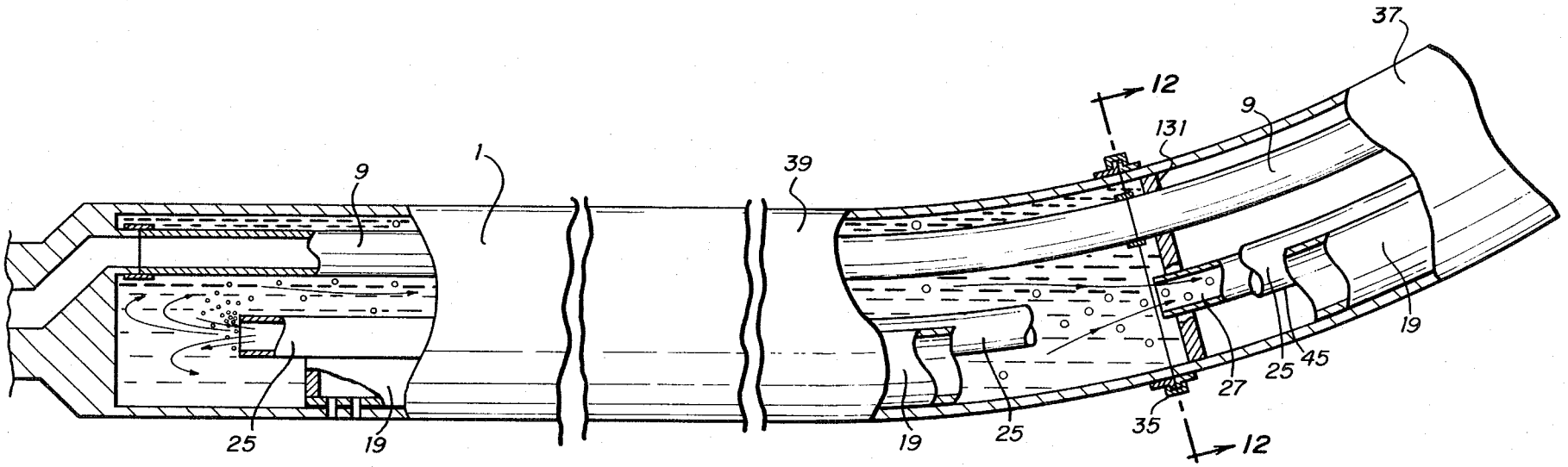
FIG. 11 is a side view, partly in section, of an alternate form for the conduit of FIG. 1.
Figure 12:
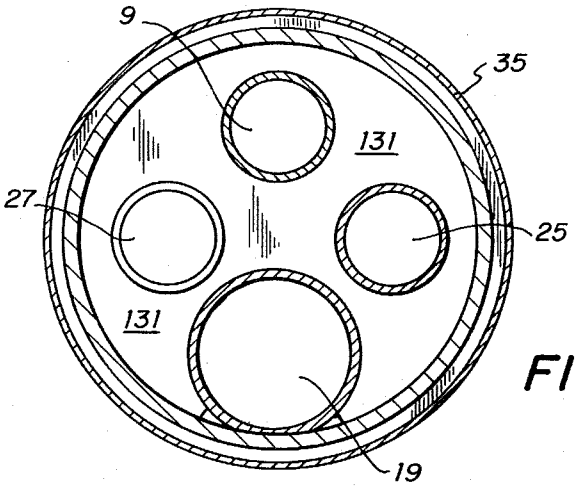
FIG. 12 is a cross-sectional view of the conduit of FIG. 11 along the line 12—12 of FIG. 11.

In the form of my invention shown in FIGS. 1–4, steam fills the major portion of the annular space inside that portion of the conduit lying within the petroleum bearing formation. Liquid condensate is collected near the terminal end of the conduit and is returned to the surface via tubular member 27. An alternate form of my invention is shown in FIGS. 11 and 12, wherein the steam flow line 25 extends to the vicinity of the terminal end of the lower conduit sections, and the condensate return line 27 terminates at the end of the upper conduit section. By operating in this manner within the optimum steam flow rate range, the lower section of the conduit will be filled with a condensate-steam mixture which will have a higher coefficient of heat transfer to the conduit wall than dry steam or steam carrying a condensate mist. Where the lower, generally horizontal portion of the conduit is of substantial length of the order of several hundred feet or more, it may be desirable to provide several spaced perforations in steam flow line 25 so that the steam vapor is more uniformly distributed in the hot condensate. Alternatively, the insulation on the steam flow line may be gradually tapered down to zero from the thickness employed on that line in the upper section. Various other design modifications may be employed to achieve the desired result of a generally uniform rate of heat transfer from the circulating steam to the conduit walls.

Sealing means 131 surrounds the various tubular members carrying the steam, condensate returns and production to confine the hot steam-condensate mixture to the lower conduit section.

By the use of my invention it is possible to simultaneously heat the petroleum containing reservoir and produce the petroleum liberated therefrom through a single well bore.

Many modifications of my invention will be apparent to those skilled in the art and the specific embodiments shown hereinabove are intended as illustrative rather than limiting.

I claim:

1. A system for recovering petroleum from a petroleum containing formation penetrated by a well bore having a substantially horizontal portion within the petroleum containing formation and extending to the earth's surface comprising:

a. a steam generator located at the earth's surface;

b. a power source at the earth's surface;

c. a flexible conduit extending from the earth's surface through a substantial length of the horizontal portion of the well bore, said conduit including:

(i) a pair of tubular members forming a closed loop for the circulating of steam from the steam generator to the vicinity of the lower terminal end of the conduit and return of aqueous condensate;

(ii) a separate tubular member extending to the vicinity of the lower terminal end of the conduit for conducting petroleum produced from the formation to the earth's surface; and (iii) a means for conducting power from the power source to the lower terminal end of said conduit;

d. means affixed to t end of the conduit for generating forward thrust upon the application of power thereto carried by said conduit; and e. at least one flow path interconnecting the exterior of the conduit within the petroleum containing formation and the separate tubular member.

2. The system of claim 1 wherein each of the tubular members forming the pair of tubulars members has an upper end and a lower end, said lower end of each of said tubular members extending to the vicinity of said lower terminal end of the conduit and the closed loop is formed by joining together said lower ends of said tubular members.

3. The system of claim 1 wherein the lower end of a first of said pair of tubular members terminates in the vicinity of said lower terminal end of said conduit, said first tubular member being spaced from said conduit to thereby form an annular space therebetween and wherein the lower end of a second of said pair of tubular members terminates at a point above the vicinity of said lower terminal end of said conduit; and wherein said closed loop is formed by said annular space between said lower ends of said tubular members.

4. The system of claim 3 wherein sealing means are provided surrounding the end of said second tubular member and the separate tubular member and power conducting means to prevent the flow of steam and condensate from the annular space within the lower end of the conduit into the annular space in the upper end of the conduit.

5. The system of claim 1 wherein the means for conducting power is an additional tubular member integral with said conduit for conducting liquid under pressure from the power source and the means for generating forward thrust is at least one rearwardly directed jet nozzle connected to said additional tubular member.

6. The system of claim 1 wherein the means for conducting power is an electric cable integral with the conduit for conducting electric power from the power source to the thrust generating means comprising at least one electric motor operation of which rotates a marine screw propeller in a direction to generate forward thrust.

7. The system of claim 1 including:

means for artificially lifting said aqueous condensate.

8. The system of claim 7 wherein said means for artificially lifting said aqueous condensate includes:

means for adding a gas to said steam at said earth's surface.

9. A system for recovering petroleum from a petroleum containing formation penetrated by a well bore having a substantially horizontal portion within the petroleum containing formation and extending to the earth's surface comprising:

a. a steam generator located at the earth's surface;

b. a power source at the earth's surface;

c. a flexible conduit extending from the vicinity of end of the bore hole to the earth's surface, said conduit including:

(i) a pair of tubular members connected together in the vicinity of the terminal end of the conduit and forming a closed loop for circulation of steam from the steam generator through the conduit;

(ii) a separate tubular member extending to the vicinity of the lower terminal end of the conduit for conducting petroleum produced from the formation to the earth's surface; and (iii) a means for conducting power from the power source to the lower terminal end of said conduit;

d. means affixed to the lower terminal end of the conduit for generating forward thrust upon the application of power thereto; and e. perforations through the wall of at least a portion of the conduit within the petroleum containing formation for permitting the flow of petroleum through the perforations into the separate tubular member.

10. A method for producing a desired substance, having a viscosity which is decreased by an increase in temperature, from a subsurface stratum; said method comprising:

a. forming a bore hole into said stratum;

b. filling at least a portion of said bore hole with liquid;

c. inserting into said bore hole a flexible conduit neutrally buoyant in said liquid, said conduit comprising a fluid conveying means and means for increasing the temperature of said desired substance;

d. heating said desired substance by closed circulation of heated fluid through said flexible conduit; and e. producing said desired substance.

11. The method of claim 10 including artificial lifting of said desired substance.

12. A method for recovering petroleum from a petroleum containing formation penetrated by a well bore having a substantially horizontal terminal portion of substantial length within the petroleum containing formation which comprises:

a. introducing into the upper end of said well bore a flexible conduit including therein a pair of tubular members at least one of which extends to the vicinity of the terminal end of the conduit and which form a closed loop adapted for the circulation of hot fluid through the conduit, a separate tubular member extending from the vicinity of the terminal end of the conduit to the other end thereof for conducting produced petroleum, means for conducting power from one end of the conduit to the other, and means affixed to the terminal end of the conduit for generating forward thrust upon the application of power;

b. introducing power into and through said power conducting means for activation of the thrust generating means to assist in the advance of the conduit through the well bore until said thrust generating means reaches the vicinity of the terminal end of the well bore;

c. terminating the introduction of power to the upper end of said conduit and connecting one of said pair of tubular members to a steam generator;

d. circulating steam through the closed loop formed by the pair of tubular members; and e. producing petroleum obtained from said formation through said separate tubular member.

13. The method of claim 12 in which the means for conducting power is the separate tubular member, the power is introduced in the form of liquid under elevated pressure, and the means for generating thrust is at least one rearwardly facing jet nozzle.

14. The method of claim 12 in which the means for conducting power are electrical conductors, the power introduced is electric, and the means for generating thrust is at least one marine screw propeller operated by an electric motor.

15. A method for recovering petroleum at the earth's surface from subterranean petroleum containing formations having insufficient reservoir pressure to cause the petroleum contained therein under reservoir conditions to drain into a well bore therein at an economically sufficient rate, said formation being penetrated by a well bore having a substantially horizontal terminal portion of substantial length within the petroleum containing formation which comprises:

a. introducing into the upper end of said well bore a flexible conduit having at the terminal end thereof means for generating forward thrust upon the application thereto of power, said conduit having means integral therewith for transmitting power;

b. during at least a portion of the continued introduction of the conduit introducing power via the power transmitting means to operate the thrust generating means to move the conduit toward the terminal end of the well bore;

c. terminating the introduction of power and circulating steam through the conduit at a pressure less than reservoir pressure to heat the petroleum and by lowering its viscosity causing it to flow into the well bore; and d. producing petroleum entering said well bore via a flow tubing carried by said conduit for recovery at the earth's surface.

16. The method of claim 15 in which artificial lift means are employed to assist in lifting the produced petroleum to the earth's surface.

17. The method of claim 15 in which at least the upper end of the flexible conduit is provided with gas lift valves communicating with the flow tubing and a gas under pressure is introduced into the upper end of the well bore to assist in lifting the produced petroleum to the earth's surface.

18. A system for recovering petroleum from a petroleum containing formation penetrated by a well bore having a substantially horizontal portion within the petroleum containing formation and extending to the earth's surface, said system comprising:

a. a steam generator located at the earth's surface;

b. a power source at the earth's surface;

c. a flexible conduit extending from the earth's surface through a substantial length of the horizontal portion of the well bore comprising a lower section lying within the petroleum containing formation and an upper section extending from the end of the lower section to the earth's surface, said conduit including:

(i) a pair of tubular members, one of which extends to the vicinity of the terminal end of the conduit and the other of which terminates at the end of the upper section of the conduit;

(ii) sealing means surrounding said pair of tubular members at the end of the upper section of the conduit so that the tubular members form a closed loop for the circulation of steam from the steam generator to the vicinity of the terminal end of the conduit and return of aqueous condensate, with the free space within the conduit in the lower section thereof being a portion of such closed loop;

(iii) a separate tubular member extending to the vicinity of the terminal end of the conduit and passing through the sealing means for conducting petroleum produced from the formation to the earth's surface; and (iv) means for conducting power from the power source to the terminal end of said conduit;

d. means affixed to the terminal end of the conduit for generating forward thrust upon the application of power thereto carried by said conduit; and e. at least one flow path interconnecting the exterior of the lower section of the conduit and the separate tubular member.

19. A method for recovering petroleum from a subterranean petroleum containing formation penetrated by a well bore having a substantially horizontal terminal portion of substantial length within the petroleum containing formation which comprises:

a. introducing into the upper end of said well bore a flexible conduit having at the terminal end thereof means for generating forward thrust upon the application thereto of power, said conduit having means integral therewith for transmitting power;

b. during at least a portion of the continued introduction of the conduit introducing power via the power transmitting means to operate the thrust generating means to move the conduit toward the terminal end of the well bore;

c. terminating the introduction of power and circulating through the conduit a mixture of steam and an inert gas to heat the petroleum contained in the petroleum containing portion of the reservoir to lower its viscosity and cause the petroleum to flow into the well bore; and d. producing the petroleum entering the well bore via a flow tubing carried by said conduit for recovery at the earth's surface.

20. The method of claim 19 in which the inert gas content of the mixture of steam and inert gas lies within the range of from 5% to 15% by weight.

21. A method for recovering petroleum from a petroleum containing formation penetrated by a well bore having a substantially horizontal terminal portion of substantial length within the petroleum containing formation which comprises:

a. introducing into the upper end of said well bore a flexible conduit including therein a pair of tubular members at least one of which extends to the vicinity of the terminal end of the conduit and which form a closed loop adapted for the circulation of hot steam through the conduit and a separate tubular member extending from the vicinity of the terminal end of the conduit to the upper end thereof for conducting produced petroleum;

b. circulating steam through the closed loop formed by the pair of tubular members; and c. concurrently producing petroleum obtained from said formation through said separate tubular member.

22. A system for recovering petroleum from a petroleum containing formation penetrated by a well bore having a substantially horizontal portion within the petroleum containing formation and extending to the earth's surface comprising:

a. a steam generator located at the earth's surface;

b. a flexible conduit extending from the earth's surface through a substantial length of the horizontal portion of the well bore, said conduit including:

(i) a pair of tubular members forming a closed loop for the circulation of steam from the steam generator to the vicinity of the terminal end of the conduit and return of aqueous condensate;

(ii) means for controlling the rate of heat flow to selected portions of the petroleum containg ing reservoir by varying the coefficient of heat transfer from the conduit; and (iii) a separate tubular member extending to the vicinity of the terminal end of the conduit for conducting petroleum produced from the formation to the earth's surface; and c. at least one flow path interconnecting the exterior of the conduit within the petroleum containing formation and the separate tubular member.

23. A system for recovering petroleum from a petroleum containing formation penetrated by a well bore and extending to the earth's surface, said system comprising:

a. a steam generator located at the earth's surface;

b. a power source at the earth's surface;

c. a conduit extending from the earth's surface through said well bore, said conduit including:

(i) a pair of tubular members forming a closed loop for the circulating of steam from the steam enerator to the vicinity of the lower terminal end of the conduit and return of aqueous condensate;

(ii) a separate tubular member extending to the vicinity of said lower terminal end of the conduit for conduting petroleum produced from the formation to the earth's surface; and (iii) a means for conducting power from the power source to said lower terminal end of the conduit;

d. means affixed to the terminal end of the conduit for generating forward thrust upon the application of power thereto carried by said conduit; and e. at least one flow path interconnecting the exterior of the conduit within the petroleum containing formation and the separate tubular member.

24. The system of claim 23 including:

means for artificially lifting said aqueous condensate.

25. The system of claim 24 wherein said means for artificially lifting said aqueous condensate includes:

means for adding a gas to said steam at said earth's surface.

26. A system for recovering petroleum from a petroleum containing formation having a well bore extending from the earth's surface into said formation, said system comprising:

a. a steam generator located at the earth s surface;

b. a conduit extending from the earth's surface and into said formation;

c. means for providing a closed loop flow path for circulating steam from said steam generator to the vicinity of said terminal end of said conduit and to return aqueous condensate to the earth's surface; and d. means for providing a separate flowpath for conducting petroleum produced from the formation to the earth's surface; and e. means for artificially lifting said aqueous condensate.

27. The system of claim 26 wherein said means for artificially lifting said aqueous condensate includes:

means for adding a gas to said steam at said earth's surface.

28. The system of claim 27 wherein said means for providing a closed loop flowpath comprises:

a first tubular member within said conduit and extending from the earth's surface and having the lower end thereof terminating in the vicinity of said lower terminal end of said conduit, said first tubular member being spaced from said conduit to thereby provide an annular space therebetween; and a second tubular member within said conduit and extending from the earth's surface and having the lower end thereof terminating at a point above the vicinity of said lower terminal end of said conduit with said lower end of fluid communication with said annular space; and sealing means surrounding said lower end of said second tubular member and said separate tubular member to prevent the flow of steam and condensate from said annular space unto said conduit above said sealing means.

29. The system of claim 27, wherein said means for providing a closed loop flowpath comprises:

a first tubular member within said conduit and extending from the earth's surface and having a lower end terminating in the vicinity of said lower terminal end of said conduit;

a second tubular member within said conduit and extending from the earth's surface and having a lower end terminating in the vicinity of said lower terminal end of said conduit; and conduit means for joining said lower ends of said first and second tubular members together.

* * * * *